US011358816B2

(12) United States Patent
Asano

(10) Patent No.: US 11,358,816 B2
(45) Date of Patent: Jun. 14, 2022

(54) TRANSPORTING DEVICE AND TRANSPORTING METHOD

(71) Applicant: FUJIFILM Corporation, Tokyo (JP)

(72) Inventor: Yuji Asano, Minami-ashigara (JP)

(73) Assignee: FUJIFILM Corporation, Tokyo (JP)

( * ) Notice: Subject to any disclaimer, the term of this patent is extended or adjusted under 35 U.S.C. 154(b) by 155 days.

(21) Appl. No.: 16/825,691

(22) Filed: Mar. 20, 2020

(65) Prior Publication Data

US 2020/0216279 A1 Jul. 9, 2020

Related U.S. Application Data

(63) Continuation of application No. PCT/JP2018/034413, filed on Sep. 18, 2018.

(30) Foreign Application Priority Data

Sep. 22, 2017 (JP) ..... JP2017-182571

(51) Int. Cl.
*B65H 7/06* (2006.01)
*B65H 5/06* (2006.01)
(Continued)

(52) U.S. Cl.
CPC ..... *B65H 7/06* (2013.01); *B65H 5/062* (2013.01); *B65H 5/38* (2013.01); *B65H 7/20* (2013.01);
(Continued)

(58) Field of Classification Search
CPC . B65H 5/06; B65H 5/062; B65H 5/38; B65H 7/00; B65H 7/02; B65H 7/06;
(Continued)

(56) References Cited

U.S. PATENT DOCUMENTS 6,019,362 A * 2/2000 Yazawa ..... B65H 3/0661 271/4.03
6,032,945 A * 3/2000 Miura ..... B65H 5/062 271/272
(Continued)

FOREIGN PATENT DOCUMENTS

EP 1661839 A1 5/2006
JP 2000-89605 A 3/2000
(Continued)

OTHER PUBLICATIONS

International Preliminary Report on Patentability and English translation of the Written Opinion of the International Searching Authority (Forms PCT/IB/326, PCT/IB/373, and PCT/ISA/237) for International Application No. PCT/JP2018/034413, dated Apr. 2, 2020.
(Continued)

*Primary Examiner* — Prasad V Gokhale
(74) *Attorney, Agent, or Firm* — Birch, Stewart, Kolasch & Birch, LLP

(57) ABSTRACT

A transporting device sends a sheet with the rotation of a first drive roller with the sheet sandwiched between a first drive roller and a driven roller. The sheet is sent to a direction to which a back surface thereof is pressed against a guide surface, and is transported to a second drive roller in a state of being pressed against the guide surface after the guide surface pushing and bending a transport path toward a front surface side. A lifted amount of the sheet from the guide surface is monitored by a sensor, and the transportation is stopped in a case where the lifted amount is equal to or larger than a predetermined amount.

11 Claims, 3 Drawing Sheets

(51) Int. Cl.
*B65H 5/38* (2006.01)
*B65H 7/20* (2006.01)

(52) U.S. Cl.
CPC .. *B65H 2301/5115* (2013.01); *B65H 2511/22* (2013.01); *B65H 2511/52* (2013.01); *B65H 2513/512* (2013.01)

(58) Field of Classification Search
CPC ..... B65H 7/20; B65H 2301/511; B65H 2301/5115; B65H 2404/1313; B65H 2404/1314; B65H 2511/22; B65H 2511/52; B65H 2513/512
See application file for complete search history.

(56) References Cited

U.S. PATENT DOCUMENTS

| | | | | |
|---|---|---|---|---|
| 8,424,870 | B2 * | 4/2013 | Van Soest | B65H 5/062 271/265.01 |
| 2007/0063428 | A1 * | 3/2007 | Detloff | B65H 5/228 271/226 |
| 2007/0280723 | A1 | 12/2007 | Kurosu | |
| 2010/0271419 | A1 | 10/2010 | Yamashita et al. | |
| 2012/0153566 | A1 * | 6/2012 | Ito | B65H 7/02 271/265.01 |
| 2018/0267454 | A1 * | 9/2018 | Uno | B65H 5/38 |

FOREIGN PATENT DOCUMENTS

| | | | |
|---|---|---|---|
| JP | 2000-351469 | A | 12/2000 |
| JP | 2003-65798 | A | 3/2003 |
| JP | 2005-262836 | A | 9/2005 |
| JP | 2007-223739 | A | 9/2007 |
| JP | 2007-320667 | A | 12/2007 |
| JP | 2009-154368 | A | 7/2009 |
| JP | 2010-269455 | A | 12/2010 |
| JP | 2012-171695 | A | 9/2012 |
| JP | 2013-160964 | A | 8/2013 |
| JP | 2015-218044 | A | 12/2015 |

OTHER PUBLICATIONS

International Search Report (Form PCT/ISA/210) for International Application No. PCT/JP2018/034413, dated Nov. 13, 2018, with English translation.
Extended European Search Report for European Application No. 18858807.3, dated Nov. 5, 2020.
Japanese Office Action for Japanese Application No. 2019-543631, dated Nov. 4, 2020, with English translation.

* cited by examiner

TRANSPORTING DEVICE AND TRANSPORTING METHOD

CROSS-REFERENCE TO RELATED APPLICATIONS

This application is a Continuation of PCT International Application No. PCT/JP2018/034413 filed on 18 Sep. 2018, which claims priority under 35 U.S.C § 119(a) to Japanese Patent Application No. 2017-182571 filed on 22 Sep. 2017. The above application is hereby expressly incorporated by reference, in its entirety, into the present application.

BACKGROUND OF THE INVENTION

1. Field of the Invention

The present invention relates to a transporting device and a transporting method in which a sheet-like transportation target object is transported.

2. Description of the Related Art

The following JP2000-089605A, JP2015-218044A, JP2013-160964A, and JP2012-171695A are known as transporting devices that transport a sheet-like transportation target object. In the transporting devices, a plurality of transporting rollers are provided along a transport path of the transportation target object, and the transportation target object is transported by a transporting roller on a downstream side (downstream side transporting roller) pulling the transportation target object sent by a transporting roller on an upstream side (upstream side transporting roller).

SUMMARY OF THE INVENTION

However, the transporting devices of the related art have a problem that damage occurs to the transportation target object, such as a crease and/or fold, as the upstream side transporting roller continues to send the transportation target object despite the fact that the downstream side transporting roller is in a state of being incapable of transporting (pulling) the transportation target object.

In view of the circumstances, an object of the present invention is to provide a transporting device and a transporting method that can prevent damage to a transportation target object.

According to an aspect of the present invention, there is provided a transporting device comprising a guide member, a sensor, and an abnormality indication detection unit. The transporting device has a pair of upstream side transporting rollers, which is disposed to face a front surface side and a back surface side of a sheet-like transportation target object and in which at least one of the upstream side transporting rollers receives supply of drive power and rotates to send the transportation target object to a downstream side, and a downstream side transporting roller, which is disposed on the downstream side of the upstream side transporting rollers, to thereby transport the transportation target object by means of the upstream side transporting roller and the downstream side transporting roller. The guide member has a guide surface, which supports the transportation target object from the back surface side, and is disposed between the upstream side transporting rollers and the downstream side transporting roller. The sensor measures a distance between the guide surface and the transportation target object. The abnormality indication detection unit detects that there is a transport abnormality indication in a case where the distance measured by the sensor is equal to or larger than a predetermined distance. The upstream side transporting rollers send the transportation target object in a direction to which the transportation target object is pressed against the guide surface, and a transport path of the transportation target object is pushed and bent toward the front surface side of the transportation target object by the guide surface.

It is preferable that the transport path is pushed and bent toward the front surface side of the transportation target object by the downstream side transporting roller.

A transportation stopping unit that stops transportation of the transportation target object in a case where the transport abnormality indication is detected may be provided.

A cleaner that slidingly contacts a front surface of the transportation target object may be disposed at a position facing the downstream side transporting roller with the transportation target object sandwiched therebetween.

The transportation target object may be a flat sheet.

At least one of the upstream side transporting rollers may have a curved part of which an outer circumferential surface is curved as an outer diameter differs according to a position in an axial direction.

According to another aspect of the present invention, there is provided a transporting method that has a sending step, a guiding step, and a pulling step, and transports a sheet-like transportation target object. In the sending step, the transportation target object is sent by a pair of upstream side transporting rollers, which is disposed to face a front surface side and a back surface side of the transportation target object and in which at least one of the upstream side transporting rollers receives supply of drive power and rotates. In the guiding step, the transportation target object is supported from the back surface side by a guide surface of a guide member disposed on a downstream side of the upstream side transporting rollers. In the pulling step, the transportation target object is pulled by a downstream side transporting roller disposed on a downstream side of the guide member. In the sending step, a transport path of the transportation target object is pushed and bent toward the front surface side of the transportation target object by sending the transportation target object in a direction to which the transportation target object is pressed against the guide surface. In the guiding step, a distance between the guide surface and the transportation target object is measured by a sensor, and in a case where the distance measured by the sensor is equal to or larger than a predetermined distance, it is detected that there is a transport abnormality indication.

In the present invention, damage to the transportation target object can be prevented.

DESCRIPTION OF THE PREFERRED EMBODIMENTS

Figure 1:
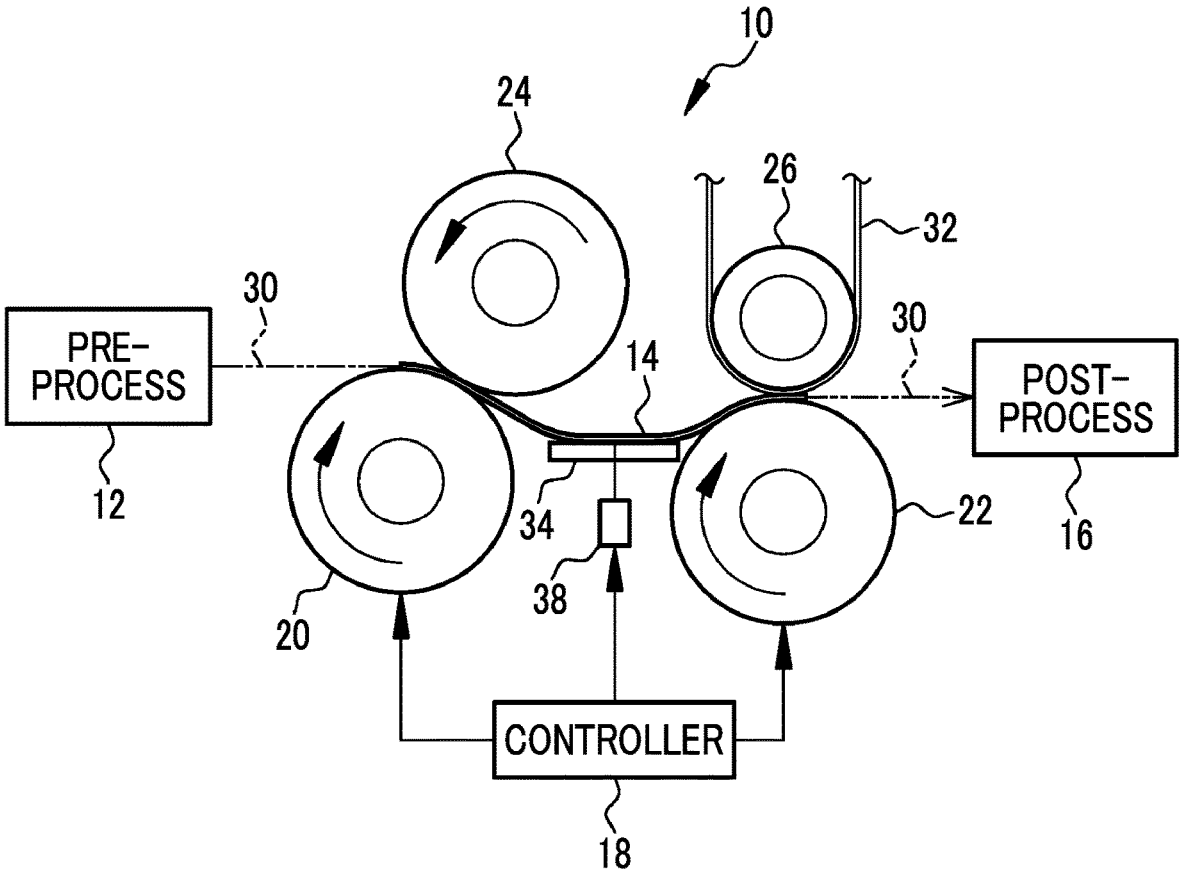
FIG. 1 is an explanatory view of a transporting device.

In FIG. 1, a transporting device 10 according to an embodiment of the present invention transports a sheet 14

(transportation target object) brought in from a pre-process 12 to a post-process 16 and cleans a front surface of the sheet 14 during the transportation. In the embodiment, the sheet 14 is a flat sheet (independent one sheet) such as a photo, and is transported in a state where the front surface faces upward and a back surface faces downward.

The transporting device 10 comprises a first drive roller 20 (upstream side transporting roller), a second drive roller 22 (downstream side transporting roller), a driven roller 24 (upstream side transporting roller), and a cleaning roller 26, in addition to a controller 18 (an abnormality indication detection unit and a transportation stopping unit) that controls driving of each unit.

The first drive roller 20 and the second drive roller 22 are rollers that rotate by receiving the supply of drive power from a drive power supplying unit (not illustrated) such as a motor, and rotates as driving thereof is controlled by the controller 18. On the other hand, the driven roller 24 is a roller that rotates by following the rotation of the first drive roller 20. The driven roller 24 is disposed so as to face the first drive roller 20 with a transport path 30 of the sheet 14 sandwiched therebetween. The sheet 14 is sandwiched between the first drive roller 20 and the driven roller 24, and is sent to a downstream side with the rotation of the first drive roller 20 (refer to FIG. 2).

The second drive roller 22 and the cleaning roller 26 are disposed on the downstream side of the first drive roller 20 and the driven roller 24. In addition, the second drive roller 22 and the cleaning roller 26 are disposed so as to face each other with the transport path 30 sandwiched therebetween. A cleaning sheet 32 (cleaner) is wound around an outer circumference of the cleaning roller 26. The front surface of the sheet 14 sent from the first drive roller 20 and the driven roller 24 is caused to slidingly contact the cleaning sheet 32 with the rotation of the second drive roller 22, and the sheet passes below the cleaning roller 26 (between the cleaning roller 26 and the second drive roller 22) (refer to FIG. 4). Accordingly, the front surface of the sheet 14 is cleaned.

Although the sheet 14 is transported and cleaned in the transporting device 10 as described above, the sheet 14 becomes damaged in a case where the sheet 14 cannot smoothly pass between the cleaning roller 26 and the second drive roller 22. Such a phenomenon, that is, so-called jamming occurs as the sheet 14 is continued to be sent from the first drive roller 20 and the driven roller 24 despite the fact that the second drive roller 22 does not normally transport the sheet 14, such as a leading end (downstream end part) of the sheet 14 is not guided between the cleaning roller 26 and the second drive roller 22. In a case where jamming occurs, damage including a crease and/or fold occurs to the sheet 14 when passing the front (upstream side) of the cleaning roller 26 and the second drive roller 22 and/or between the cleaning roller 26 and the second drive roller 22.

In order for the transporting device 10 to prevent jamming described above, a guide member 34 is provided between the upstream side transporting rollers (the first drive roller 20 and the driven roller 24) and the downstream side transporting roller (the second drive roller 22), and the sheet is transported while the back surface of the sheet 14 is pressed against the guide member 34.

Figure 2:
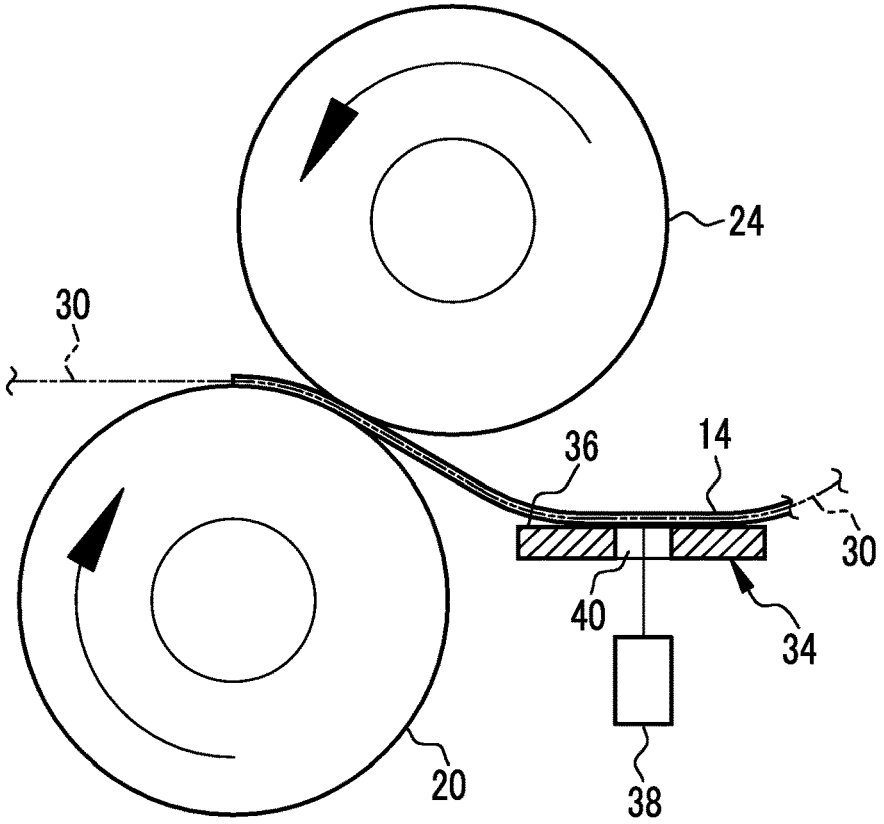
FIG. 2 is an explanatory view of an upstream side transporting roller and a guide member.

As illustrated in FIG. 2, the guide member 34 has an upper surface that is a guide surface 36, and is disposed below the transport path 30. In addition, the guide member 34 and the upstream side transporting rollers (the first drive roller 20 and the driven roller 24) are configured in a state where the transport path 30 of the sheet 14 sent by the upstream side transporting rollers is pushed and bent toward a front surface side by the guide surface 36. Specifically, in the embodiment, the guide surface 36 is levelled, and a disposition position of the driven roller 24 is a position offset to the downstream side with respect to a vertical direction of the first drive roller 20.

By doing so, after being sent obliquely downward from the upstream side transporting rollers to the guide surface 36, the sheet 14 is pushed and bent toward the front surface side (horizontal direction) by abutting against the guide surface 36 (the transport path 30 is pushed and bent) and is transported to the downstream side transporting roller (the second drive roller 22) along the guide surface 36 in a state where the back surface is pressed against the guide surface 36. The up-and-down movement of the sheet 14 (in particular, a leading end part of the sheet 14) is suppressed by transporting (sending) the sheet 14 while pressing against the guide surface 36 as described above. Consequently, stable transportation is possible, thereby contributing to the prevention of jamming.

In addition, a sensor 38 is provided in the transporting device 10, and detects a lifted amount of the sheet 14 from the guide surface 36 (a distance between the guide surface 36 and the back surface of the sheet 14). The sensor 38 is formed by, for example, a known distance-measuring sensor that measures a distance using laser light, and is disposed below the guide member 34. The guide member 34 is provided with a through-hole 40 that exposes the back surface of the sheet 14, and a distance to the back surface of the sheet 14 is measured via the through-hole 40.

Figure 3:
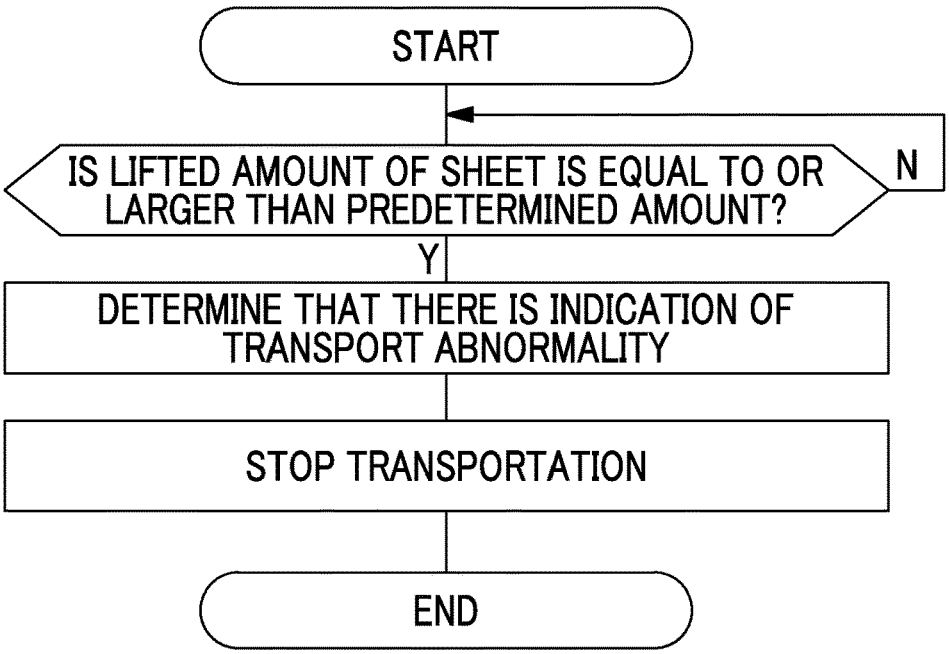
FIG. 3 is a flow chart showing the flow of stopping transportation based on a lifted amount of a sheet.

The controller 18 controls the driving of the sensor 38, and information obtained from the sensor 38, that is, information related to a distance from the sensor 38 to the back surface of the sheet 14 is input to the controller 18. As shown in FIG. 3, in a case where a lifted amount of the sheet 14 (a distance from the sensor 38 to the sheet 14) is equal to or larger than a predetermined amount (a predetermined distance), the controller 18 determines that there is a jamming indication (transport abnormality indication) based on the information input from the sensor 38, and stops the transportation of the sheet 14 (the rotation of the first drive roller 20 and the second drive roller 22). In the embodiment, the predetermined distance is a distance longer than a distance from the sensor 38 to the guide surface 36 by 2 mm. That is, in the embodiment, in a case where the lifted amount of the sheet 14 (a distance from the guide surface 36) is 2 mm or larger, the transportation of the sheet 14 is stopped under an assumption that there is a jamming indication.

By stopping the transportation as described above immediately before a timing of moment when the distance from the sensor 38 to the sheet 14 is equal to or larger than the predetermined distance, that is, immediately before a timing of moment when the sheet 14 is lifted from the guide surface 36 by the predetermined amount (predetermined distance) or more, jamming can be more reliably prevented. That is, since jamming occurs in a case where the upstream side transporting rollers continue to send the sheet 14 despite the fact that the downstream side transporting roller does not transport (pull) the sheet, a state where the sheet 14 is simply lifted from the guide surface 36 (immediately before a timing of moment of being lifted) is not enough to be called jamming. However, in a case where the sheet 14 is lifted from the guide surface 36 despite the fact that the sheet is transported while being pressed to the guide surface 36, there is a possibility of developing into jamming as the transportation continues. Since the transporting device 10 stops the transportation at a stage of such an indication (a stage before jamming occurs), jamming can be more reliably prevented.

Figure 4:
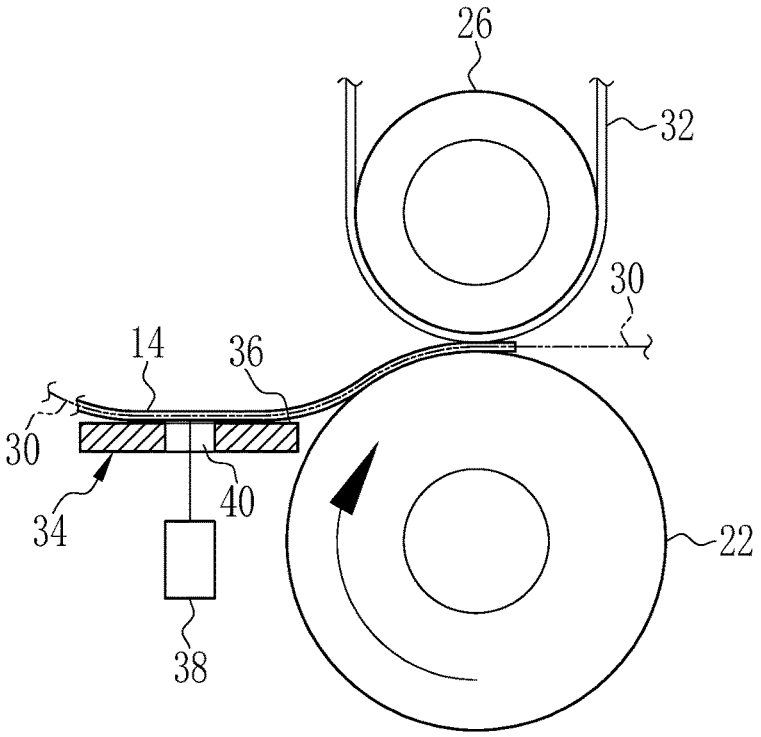
FIG. 4 is an explanatory view of the guide member, a downstream side transporting roller, and a cleaning roller.

As illustrated in FIG. 4, the transporting device 10 is configured such that the transport path 30 of the sheet 14 from the guide surface 36 to the cleaning roller 26 (the cleaning sheet 32) is pushed and bent toward the front surface side by the second drive roller 22. Specifically, in the embodiment, the second drive roller 22 and the cleaning roller 26 are disposed in a state where a position of bonding between the second drive roller 22 and the cleaning roller 26 (the cleaning sheet 32) (a position where the sheet 14 passes while slidingly contacting the cleaning sheet 32) is a position higher than the guide surface 36.

By doing so, after being horizontally sent from the guide surface 36, the sheet 14 is pushed and bent toward the front surface side (the transport path 30 is pushed and bent) by abutting against a circumferential surface of the second drive roller 22 before slidingly contacting the cleaning roller 26 (the cleaning sheet 32), and is guided (transported) to the cleaning roller 26 (the cleaning sheet 32) along the rotation of the second drive roller 22 in a state where the back surface is pressed against the second drive roller 22. Since the sheet 14 is guided (transported) to the position of bonding between the second drive roller 22 and the cleaning roller 26 (the cleaning sheet 32) in a state of being pressed against the second drive roller 22 as described above, more reliable guiding (transportation) is possible, contributing to the prevention of jamming.

Hereinafter, procedures of cleaning the sheet 14 while transporting the sheet by the transporting device 10 described above will be described. The sheet 14 is brought into the transporting device 10 from the pre-process 12. The sheet 14 brought in from the pre-process 12 is sent to the downstream side by the upstream side transporting rollers (the first drive roller 20 and the driven roller 24) (sending step).

In the sending step, the sheet 14 is sent to a direction to which the back surface is pressed against the guide surface 36. Accordingly, in a state where the transport path 30 is pushed and bent toward the front surface side of the sheet 14 and the sheet 14 is pressed against the guide surface 36 (a state of being supported from a back surface side), the sheet is sent (transported) to the downstream side transporting roller (the second drive roller 22) (guiding step). By doing so, jamming (transport abnormality) can be prevented (refer to FIG. 2).

In addition, in the guiding step, the sensor 38 measures the lifted amount of the sheet 14 from the guide surface 36. In a case where the lifted amount is equal to or larger than the predetermined amount, it is determined that there is a jamming indication, and the transportation (the driving of the first drive roller 20 and the second drive roller 22) is stopped. Accordingly, jamming is prevented (refer to FIGS. 2 and 3).

The sheet 14 sent from the guide member 34 (the guide surface 36) to the downstream side is pulled by the second drive roller 22 and is further transported to the downstream side (pulling step), and the front surface of the sheet is cleaned by the cleaning roller 26 (the cleaning sheet 32) slidingly contacting the front surface during the transportation (refer to FIG. 4).

In addition, in the pulling step, the sheet 14 is sent to a direction to which the back surface is pressed against the second drive roller 22. Accordingly, the sheet 14 abuts against the circumferential surface of the second drive roller 22 before slidingly contacting the cleaning roller 26 (the cleaning sheet 32), and the transport path 30 is pushed and bent toward the front surface side of the sheet 14. In a state of being pressed against the second drive roller 22, the sheet 14 is guided (transported) to the cleaning roller 26 (the cleaning sheet 32) along with the rotation of the second drive roller 22. Accordingly, jamming is prevented (refer to FIG. 4).

As described above, jamming can be prevented in the transporting device 10 by a configuration where the sheet 14 is pressed against the guide surface 36 and the transport path 30 is pushed and bent toward the front surface side of the sheet 14 (hereinafter, a configuration 1), a configuration where transportation stops in a case where the lifted amount of the sheet 14 from the guide surface 36 is equal to or larger than the predetermined amount (hereinafter, a configuration 2), and a configuration where the sheet 14 is pressed against the downstream side transporting roller (the second drive roller 22) and the transport path 30 is pushed and bent toward the front surface side of the sheet 14 (hereinafter, a configuration 3).

The present invention is not limited to the embodiment, and detailed configurations can be changed as appropriate. For example, although an example comprising all of the configurations 1 to 3 is described in the embodiment, jamming may be prevented by only one configuration or a combination of two configurations out of the configurations 1 to 3.

Figure 5:
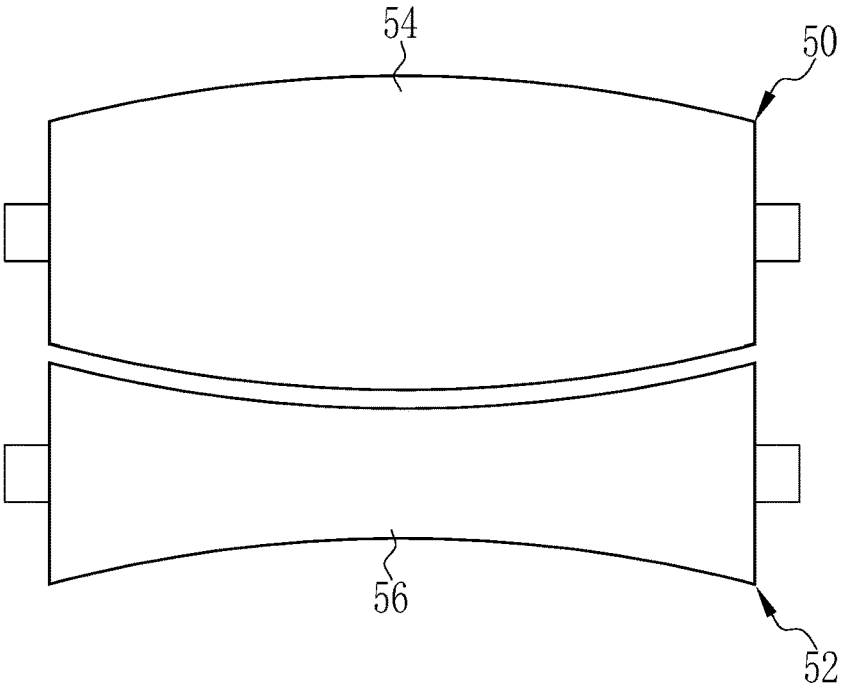
FIG. 5 is an explanatory view of an upstream side transporting roller having a curved part.

In addition, as illustrated in FIG. 5, a roller having a curved part may be used as the upstream side transporting roller. The same members as the embodiment described above will be assigned with the same reference signs and description thereof will be omitted in FIG. 5.

In FIG. 5, upstream side transporting rollers 50 and 52, between which the sheet 14 is sandwiched, send the sheet 14 to the downstream side by at least one of the upstream side transporting rollers receiving the supply of drive power and rotating. A diameter of a center part of the upstream side transporting roller 50 in an axial direction that is parallel to the front surface and back surface of the sheet 14 and is orthogonal to a transporting direction (transport path) of the sheet 14 is formed to be larger than diameters of both side parts in the axial direction. Accordingly, a curved outer circumferential surface becomes a curved part 54. In contrast to the upstream side transporting roller 50, by forming a diameter of a center part of the upstream side transporting roller 52 in the axial direction smaller than diameters of both side parts in the axial direction, a curved outer circumferential surface becomes a curved part 56.

Thus, since the sheet 14 sent from the upstream side transporting rollers 50 and 52 is curved in the axial direction and thereby stiffness with respect to pushing and bending of the front surface side and the back surface side is high, the sheet can be more firmly pressed against the guide surface 36 (refer to FIG. 2) and/or the second drive roller 22 (refer to FIG. 4). Accordingly, jamming can be prevented more reliably.

Although the roller (roller of which the entire outer circumferential surface is the curved part) of which the entire outer circumference (the whole in the axial direction) is curved is described as an example in FIG. 5, the same effects can be achieved even in a case where a roller of which a part of an outer circumference (a part in the axial direction) is curved is used as the upstream side transporting roller. In addition, although an example in which a curved part is provided also in one upstream side transporting roller so as to correspond to the other upstream side transporting roller is described in FIG. 5, a configuration where a curved part is provided in only one upstream side transporting roller and an outer circumferential part of the other upstream side transporting roller is formed by an elastic body, for example, rubber, so as to be modified to correspond to one upstream side transporting roller instead of providing a curved part in the other upstream side transporting roller may be adopted.

In addition, although an example in which the sheet is cleaned by the cleaning sheet wound around the cleaning roller is described in the embodiment, the sheet may be directly cleaned by a cleaning roller which is assigned to the outer circumferential surface and has the same function as the cleaning sheet, instead of providing the cleaning sheet.

In addition, although an example in which the present invention is applied to the transporting device that performs transportation and cleaning is described in the embodiment, the present invention may be applied to a transporting device that performs only transportation or processing other than transportation and cleaning (for example, stretching with respect to a width direction and/or a transporting direction and/or application of a material for adding a function with respect to a base sheet).

In addition, although an example in which the present invention is applied to the transporting device that transports the flat sheet is described in the embodiment, the present invention may be applied to a transporting device that transports a series of strip-like sheets. However, the present invention prevents malfunction (jamming) that occurs due to the continuation of sending by the upstream side transporting roller despite the fact that the downstream side transporting roller is in a transportation incapable state, such malfunction is likely to occur in a case where the leading end part of the sheet reaches the downstream side transporting roller or passes the downstream side transporting roller. That is, the malfunction described above is unlikely to occur in the first place in the transporting device that transports the strip-like sheet. Accordingly, the present invention can obtain a remarkable effect in a case of being applied to the transporting device that transports the flat sheet.

In addition, although an example in which transportation stops in a case where the lifted amount of the sheet 14 (the distance from the guide surface 36) is 2 mm or more is described in the embodiment, the lifted amount of the sheet 14 at which the transportation is stopped can be freely set.

Herein, it is preferable for the lifted amount of the sheet 14 at which the transportation is stopped to be smaller from the perspective of more reliable prevention of jamming. For this reason, it is more preferable to stop the transportation in a case where the lifted amount is 1 mm, and it is even more preferable to stop the transportation in a case where the lifted amount is 0.5 mm.

As the lifted amount of the sheet 14 at which the transportation is stopped is set to be smaller, transportation is more likely to be stopped despite the fact that a lifted degree is not enough to develop into jamming. Thus, there is a high possibility that smooth transportation is obstructed. For this reason, it is preferable that the lifted amount of the sheet 14 at which transportation is stopped is approximately 2 mm, more specifically, in a range of 1.5 mm or more to 2.5 mm or less in consideration of a perspective of both of prevention of jamming and smooth transportation.

In addition, since it is sufficient that the guide member 34 is a member that is disposed between the upstream side transporting rollers and the downstream side transporting roller and guides the sheet 14 from the back surface side, specific configurations, such as a shape and a material, and a disposition position are not limited to the embodiment.

However, in order to more reliably prevent abnormal transportation by the sheet 14 being wrapped below the guide member 34 due to a gap between the upstream side transporting rollers and the guide member 34, it is preferable that the gap between the upstream side transporting rollers and the guide member 34 is as small as possible.

In addition, even when the sheet 14 is guided above the guide member 34 (the guide surface 36), the sheet 14 is obstructed in a case where an approach angle of the sheet 14 to the guide surface 36 is excessively steep (a case of being close to vertical), and there is a possibility that the sheet 14 does not pass above the guide surface 36 without being pressed against the guide surface 36 in a case where the approach angle is slight (a case of being close to 0°). For this reason, it is preferable that the approach angle of the sheet 14 to the guide surface 36 is 10° or more and 30° or less, and it is more preferable that the approach angle is 15° or more and 25° or less.

EXPLANATION OF REFERENCES

10: transporting device
12: pre-process
14: sheet (transportation target object)
16: post-process
18: controller (abnormality indication detection unit and transportation stopping unit)
20: first drive roller (upstream side transporting roller)
22: second drive roller (downstream side transporting roller)
24: driven roller (upstream side transporting roller)
26: cleaning roller
30: transport path
32: cleaning sheet (cleaner)
34: guide member
36: guide surface
38: sensor
40: through-hole
50, 52: upstream side transporting roller
54, 56: curved part

What is claimed is:

1. A transporting device that comprises a pair of upstream side transporting rollers, which is disposed to face a front surface side and a back surface side of a sheet transportation target object and in which at least one of the upstream side transporting rollers receives supply of drive power and rotates to send the transportation target object to a downstream side, and a downstream side transporting roller, which is disposed on the downstream side of the upstream side transporting rollers, to thereby transport the transportation target object by means of the upstream side transporting roller and the downstream side transporting roller, the device further comprising:

a guide member that has a guide surface, which supports the transportation target object from the back surface side, and is disposed between the upstream side transporting rollers and the downstream side transporting roller;

a sensor that measures a distance between the guide surface and the transportation target object; and a controller that detects that there is a transport abnormality indication in a case where the distance measured by the sensor is equal to or larger than a predetermined distance, wherein the upstream side transporting rollers send the transportation target object in a direction to which the transportation target object is pressed against the guide surface, and a transport path of the transportation target object is pushed and bent toward the front surface side of the transportation target object by the guide surface, wherein the transport path is pushed and bent toward the front surface side of the transportation target object by the downstream side transporting roller.

2. The transporting device according to claim 1, wherein the controller that stops transportation of the transportation target object in a case where the transport abnormality indication is detected.

3. The transporting device according to claim 2, wherein a cleaner that slidingly contacts a front surface of the transportation target object is disposed at a position facing the downstream side transporting roller with the transportation target object sandwiched therebetween.

4. The transporting device according to claim 3, wherein the transportation target object is a flat sheet.

5. The transporting device according to claim 2, wherein the transportation target object is a flat sheet.

6. The transporting device according to claim 2, wherein at least one of the upstream side transporting rollers has a curved part of which an outer circumferential surface is curved as an outer diameter differs according to a position in an axial direction.

7. The transporting device according to claim 1, wherein a cleaner that slidingly contacts a front surface of the transportation target object is disposed at a position facing the downstream side transporting roller with the transportation target object sandwiched therebetween.

8. The transporting device according to claim 7, wherein the transportation target object is a flat sheet.

9. The transporting device according to claim 1, wherein the transportation target object is a flat sheet.

10. The transporting device according to claim 1, wherein at least one of the upstream side transporting rollers has a curved part of which an outer circumferential surface is curved as an outer diameter differs according to a position in an axial direction.

11. A transporting method of transporting a sheet transportation target object, the method comprising:

a sending step of sending the transportation target object by a pair of upstream side transporting rollers, which is disposed to face a front surface side and a back surface side of the transportation target object and in which at least one of the upstream side transporting rollers receives supply of drive power and rotates;

a guiding step of supporting the transportation target object from the back surface side by a guide surface of a guide member disposed on a downstream side of the upstream side transporting rollers; and a pulling step of pulling the transportation target object by a downstream side transporting roller disposed on a downstream side of the guide member, wherein in the sending step, a transport path of the transportation target object is pushed and bent toward the front surface side of the transportation target object, and the transport path is pushed and bent toward the front surface side of the transportation target object by the downstream side transporting roller by sending the transportation target object in a direction to which the transportation target object is pressed against the guide surface, and in the guiding step, a distance between the guide surface and the transportation target object is measured by a sensor, and in a case where the distance measured by the sensor is equal to or larger than a predetermined distance, it is detected that there is a transport abnormality indication.

* * * * *